United States Patent [19]

Krueger, Jr. et al.

[11] Patent Number: 4,870,375

[45] Date of Patent: Sep. 26, 1989

[54] DISCONNECTABLE MICROSTRIP TO STRIPLINE TRANSITION

[75] Inventors: James W. Krueger, Jr., Liverpool; Blake A. Carnahan, Cazenovia; Allan A. Schill, North Syracuse; Albert H. Berical, Liverpool; Cousby Younger, Jr., Syracuse, all of N.Y.

[73] Assignee: General Electric Company, Syracuse, N.Y.

[21] Appl. No.: 237,089

[22] Filed: Aug. 26, 1988

Related U.S. Application Data

[63] Continuation-in-part of Ser. No. 126,038, Nov. 27, 1987, abandoned.

[51] Int. Cl.[4] ..... H01P 5/00

[52] U.S. Cl. ..... 333/33; 333/246

[58] Field of Search ..... 333/33, 238, 246, 260

[56] References Cited

U.S. PATENT DOCUMENTS

| | | | |
|---|---|---|---|
| 3,201,721 | 8/1965 | Voelcker | 333/33 |
| 4,143,342 | 3/1979 | Cain et al. | 333/33 |
| 4,208,642 | 6/1980 | Saunders | 333/246 |
| 4,365,214 | 12/1982 | Shillady | 333/33 |
| 4,724,409 | 2/1988 | Lehman | 333/238 X |
| 4,733,202 | 3/1988 | Forterre et al. | 333/33 X |

FOREIGN PATENT DOCUMENTS

| | | | |
|---|---|---|---|
| 111401 | 7/1983 | Japan | 333/33 |

*Primary Examiner*—Paul Gensler

*Attorney, Agent, or Firm*—Richard V. Lang; Stephen A. Young; Fred Jacob

[57] ABSTRACT

The invention relates to a microstrip to stripline transition which achieves good electrical performance and permits easy, solderless disconnection. The upper portion of the stripline is omitted permitting a flying lead bonded to the microstrip conductor, and which extends across a gap, to be held in contact with the stripline conductor by a removable filler block, which replaces the omitted upper portion of the stripline. The air gap, and the width of the stripline and microstrip conductors adjacent the air gap are dimensioned to form the electrical equivalent of a pi network to achieve a desired response.

The filler block is held in place, in one embodiment, by an elongated conductor bridging the upper and lower ground planes of the stripline and which is cut away to form a short waveguide section encircling the transition. The waveguide section is dimensioned to favor only a desired TEM stripline mode and suppress undesired waveguide modes for increased transition efficiency over a desired band. The side walls of the waveguide section are made wide to reduce radiation from the stripline adjoining the transition.

9 Claims, 4 Drawing Sheets

DISCONNECTABLE MICROSTRIP TO STRIPLINE TRANSITION

RELATED APPLICATION

The present application is a Continuation-In-Part of the patent application of James William Krueger, Jr., Blake Allen Carnahan, Allan Augustus Schill and Albert Henry Berical, Ser. No. 126,038, filed Nov. 27, 1987, entitled A DISCONNECTABLE MICROSTRIP TO STRIPLINE TRANSITION, now abandoned application.

BACKGROUND OF THE INVENTION

1. Field of The Invention

The invention relates to transitions between microstrip and stripline transmission lines and more particularly to a transition that permits easy, solderless disconnection.

2. Prior Art

In high frequency circuits both microstrip and stripline transmission lines are in common use. Each has its place because of its special advantages and both are economical and susceptible to automated fabrication.

The microstrip transmission line is preferable in circuits requiring active components or the inclusion of monolithically integrated circuits in a hybrid mode of assembly. In such applications the provision of a circuit disposed on a dielectric layer over a single ground plane, provides efficient and convenient interconnection. On the other hand, the use of a stripline including a second dielectric and a second ground plane, covering such circuit components, in addition to the difficulties in assembly, would preclude access to the circuit components for "in vitro" testing, trimming or circuit repair. Accordingly, the microstrip transmission line with a single ground plane and single dielectric layer has been the conventional selection for active circuits.

Stripline, on the other hand, has found extensive use in passive networks as, for instance, where branching and distribution occurs. In passive networks, conductor runs which are thin and usually of equal thickness are readily formed and supported between the paired dielectric layers and paired ground planes of stripline. The need for trimming and repair is infrequent in such passive circuits, and with little need for access after assembly, the use of a covered construction is not a disadvantage. Stripline construction has, in fact, definite advantages in passive circuits. The circuits are physically protected from damage and electrically shielded. In addition, the isolation between runs is very good allowing for more compact layouts and minimized losses.

The fact that circuits employing stripline and microstrip transmission paths have complementary advantages has tended to bring both into coexistence in the same electronic assemblies. Thus the need has arisen for economical and efficient transitions between stripline and microstrip circuitry. In addition, when the costs of individual circuits become substantial, it is important to have a transition which permits easy connection and disconnection.

SUMMARY OF THE INVENTION

Accordingly, it is an object of the invention to provide an improved microstrip to stripline transition.

It is another object of the invention to provide a microstrip to stripline transition which is easily disconnected.

It is still another object of the invention to provide a disconnectable microstrip to stripline transition which is of high electrical performance.

These and other objects of the invention are achieved in a novel combination comprising a mechanically rigid chassis, a first electronic circuit employing microstrip signal transmission paths of a given characteristic impedance (Z), a second electronic circuit employing stripline signal transmission paths of the same characteristic impedance (Z), the lower portion (dielectric layer and ground plane) of the stripline having a rectangular extension with ground plane projecting beyond the upper portion (dielectric layer and ground plane), the electronic circuits, when attached to the chassis, being positioned to provide a short air gap at the rectangular extension of the stripline suitable for convenient interconnection, and demountable transitioning means.

Further in accordance with the invention, the demountable transitioning means comprises a widened microstrip conductor, and a widened stripline conductor adjacent the air gap, each exhibiting shunt capacitance, and a flexible flying lead exhibiting series inductance, extending across the air gap and overlapping the stripline conductor, the combination of shunt capacitances and the series inductance providing a desired pass band.

The demountable transitioning means further includes means to suppress the undesired waveguide mode in the transition to facilitate transition efficiency in the desired stripline mode and to suppress radiation by fringing fields at the junction between said microstrip and stripline sections. A fourth removable dielectric layer and a fourth removable ground plane are provided which continue the upper portion of the rectangular stripline extension to the air gap.

In accordance with one embodiment of the invention, in order to suppress the undesired waveguide mode, the conductive member which provides the fourth ground plane provides a pair of vertical conductors containing the fourth dielectric layer and the extension of the lower portion of the stripline and defining side walls of a waveguide section dimensioned to suppress the waveguide mode through the desired pass band. To suppress radiation by fields in the stripline fringing the waveguide section, the same conductive member provides a pair of vertical conductors at the air gap extending to both sides of the waveguide section. The conductive members may be a single block having a length substantially longer than the width of the cutout section, and having a transverse rectangular cutout forming the top and sides of the waveguide section.

In accordance with a second embodiment of the invention, the ground plane and fourth dielectric are removable members while the waveguide section and fringing field suppression are achieved by thin conductive layers attached to the surfaces of the stripline at the sides of the waveguide section, and extending from the waveguide section at the air gap.

Means are further provided to insure positive contact at the transition between the lower ground planes, between the ground plane of the filler and upper ground plane, and between upper and lower ground planes. These means include a suitably dimensioned screw fastened plate, a resilient conductor placed beneath the circuits, and conductive tabs between upper and lower ground plates adjacent the air gap.

BRIEF DESCRIPTION OF THE DRAWINGS

The inventive and distinctive features of the invention are set forth in the claims of the present application. The invention itself, however, together with further objects and advantages thereof may best be understood by reference to the following description and accompanying drawings in which:

FIG. 5A being a side elevation view of the transition when connected, FIG. 5B being an exploded side elevation view of the transition when disconnected, and FIG. 5C being a plan view of the transition, showing the dimensions critical to electrical performance.

DESCRIPTION OF THE PREFERRED EMBODIMENT

Figure 1:
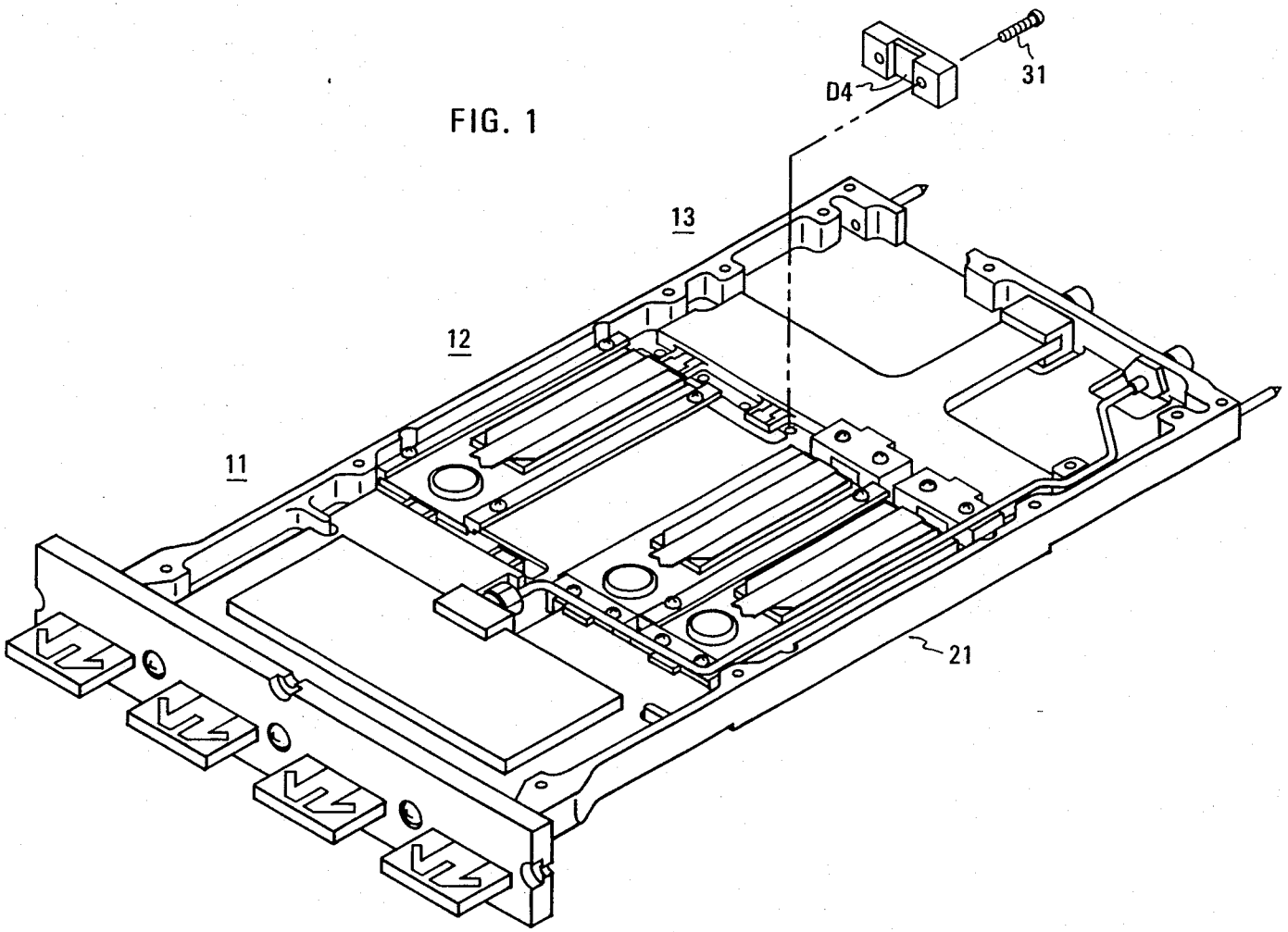
FIG. 1 is an illustration in perspective of a chassis containing four removable circuits or "modules" containing active components, using microstrip transmission line, each electrically connected between two distribution circuits, also removable, employing stripline, the arrangement requiring disconnectable microstrip to stripline transitions at each circuit to circuit interface.

FIG. 1 shows a chassis, from which the cover plate has been removed, containing the electronic circuits used to operate four elements of a phased array in a radar system operating from 5 to 6 GHz.

A high performance phased array radar system may be expected to have from 2,000 to 4,000 antenna elements at this frequency. Assuming that each chassis couples to four such antenna elements, one may expect from 500 to 1,000 such chassis in one system. The antenna elements are spaced from about one-half to two-thirds wavelengths apart, depending upon the scanning range. If a relatively low vertical scanning range is contemplated, the vertical spacing of the antenna elements, may be about two-thirds of a wavelength. If a relatively large horizontal scanning range is contemplated, the horizontal spacing between dipole elements will be about one-half wavelength. The antenna elements, if dipoles will be oriented in vertical planes, under these assumptions because of the greater available space in the vertical direction.

The demand that the cross-sectional area of the antenna operating circuitry not exceed the area dimensions of the array, forces the cross-sectional area of each chassis containing the antenna operating circuits to stay within the one-half to two-thirds wavelength dimensions allowed per antenna element. The benefit from this spacial restriction is that all r.f. paths may be of equal length and all r.f. components in these paths may be interchanged.

In the example at hand, the electronic circuits, which operate four antenna elements, fall within an overall cross-sectional dimension of 16 cm×2.7 cm, or 4 cm×2.7 cm per antenna element, which is compact enough to lie within the available spacing at 5 to 6 GHz.

The electronic circuits assembled within the chassis, which with the chassis may be called a "sub-assembly", includes the operating electronics necessarily in direct association with the antenna elements in a phased array radar system. The operating electronics includes an antenna distribution circuit 11, a phase shifter and T/R circuit 12, and a "beamformer" distribution circuit 13. In addition, the control circuits, together with local power supplies may be included in the sub-assembly to implement the steering commands to the phase shifter from a remote control computer.

The antenna distribution circuit 11 has three functions. In transmission, it couples the outputs of four high power amplifiers on an individual basis to each of four antenna elements. In reception, the antenna distribution network delivers the signal returns from four dipole elements on an individual basis to each of four low noise amplifiers. During monitoring of the state of the circuits in the subassembly, particularly the phase shifter, couplers are provided to check the phase of the signal at each antenna element for calibration purposes. The antenna distribution circuit 11 is passive, and is most conveniently carried out using stripline transmission lines, which provides good shielding between circuits in the chassis, at low cost, and with the necessary compactness.

The beamformer distribution circuit 13 distributes a signal multiplexed from four separate receiving antennas to a single channel leading to the beamformer during reception, and similarly couples signals from the beamformer intended to operate upon four antenna elements The beamformer distribution circuit has no active elements, and is preferably carried out using stripline transmission lines.

The phase shifter and T/R circuit or "module" 12 is connected between the antenna distribution circuit and the beamformer distribution circuit. It requires both active and passive elements. While it may eventually be formed on a single monolithic Gallium Arsenide substrate, present economics dictate a hybrid construction with several "MMIC"s. In the construction of the module, microstrip construction is presently the only practical approach.

Figure 2:
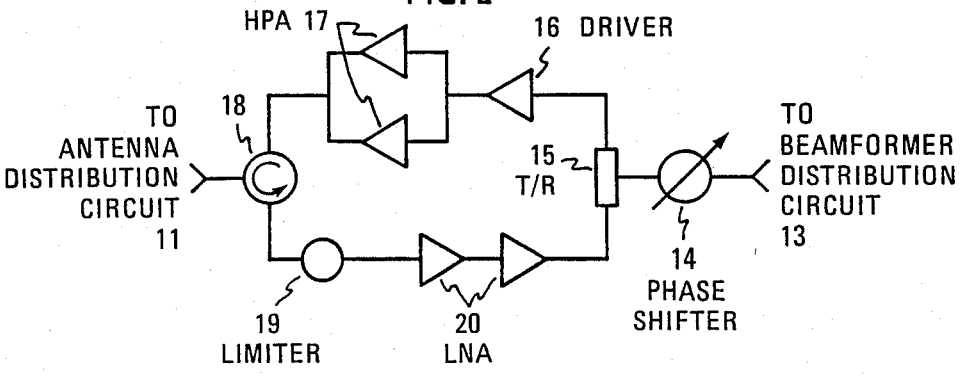
FIG. 2 is a simplified block diagram of the active circuitry of one module.

A block diagram of the module 12 is illustrated in FIG. 2. The mounting and signal connections made to a module are shown in the exploded view of FIG. 3. The blocks in the path from the beamformer to the antenna, assuming transmission and commencing at the signal connector, include a phase shifter 14, a T/R switch 15 set for transmission, a driver 16, a high power amplifier 17, and a circulator 18.

In reception, commencing at the antenna distribution circuit connector and continuing to the connector to the beamformer distribution circuit, the blocks include the circulator 18, a limiter 19, and a low noise amplifier (LNA) 20. The low noise amplifier output then passes via the T/R block 15, set for reception, to the phase shifter 14.

The connectors providing for signal connection into and out of each "module" 12 are required to be disconnectable, i.e. disconnectable without deformation or unsoldering, so that the module, which contains the active circuitry in the sub-assembly, may be easily taken out upon failure of the active circuitry and replaced without change in system performance. Each is required to provide a transition between stripline in the antenna or beam former distribution circuit and microstrip in the module, which in addition to being disconnectable, must provide an efficient wideband signal path. The transition must be of low reflection and of low dissipation and must preserve good positive conductive contacts. It must not be a source of radiation to adjacent modules.

Figure 3:
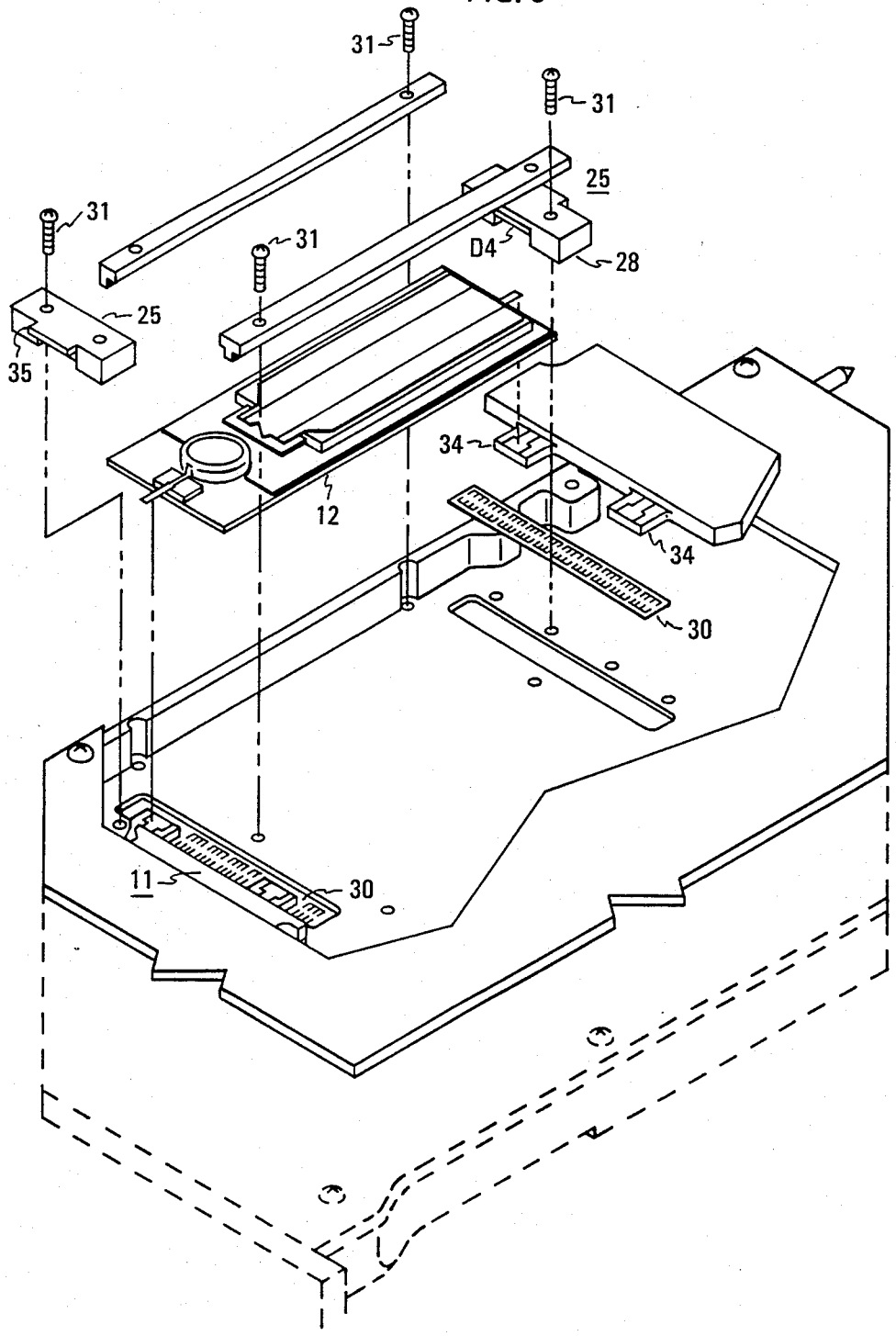
FIG. 3 is an exploded perspective view of the mounting and electrical connections to two distribution circuits of one module, using a pair of disconnectable microstrip to stripline transitions in accordance with a first embodiment of the invention.

Two disconnectable stripline to microstrip transitions in accordance with a first embodiment of the invention and having the foregoing properties are shown in the exploded view of FIG. 3. FIG. 3 shows a portion of the antenna distribution circuit 11 associated with one transition, the module 12, and a portion of the beamformer distribution circuit 13 associated with a second of the two transitions. All three circuits are assembled into the chassis 21 using screws and plates which permit easy removal. The complete sub-assembly and the disposition of the individual circuits in the chassis are best seen in FIG. 1. The chassis is mechanically rigid and in the example contains recesses for accepting the electronic circuits with screw holes providing the means for holding these circuits in place.

Figure 5A:
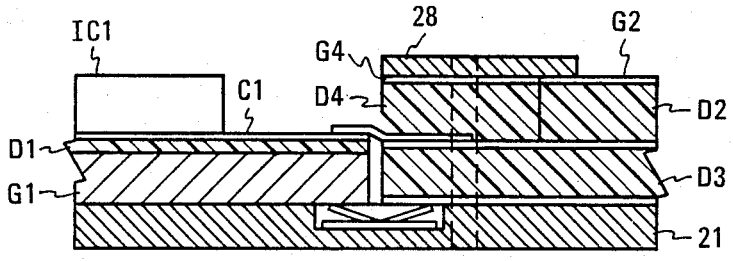
FIGS. 5A, 5B, and 5C are figures illustrating the construction details of a disconnectable microstrip to stripline transition in accordance with a first embodiment of the invention.
Figure 5B:
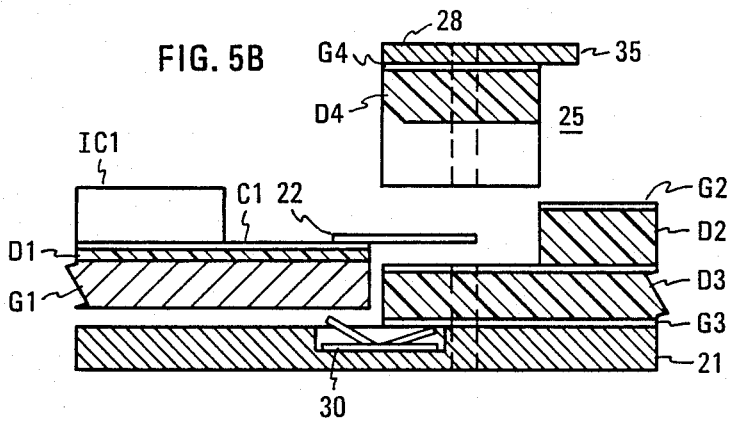
Figure 5C:
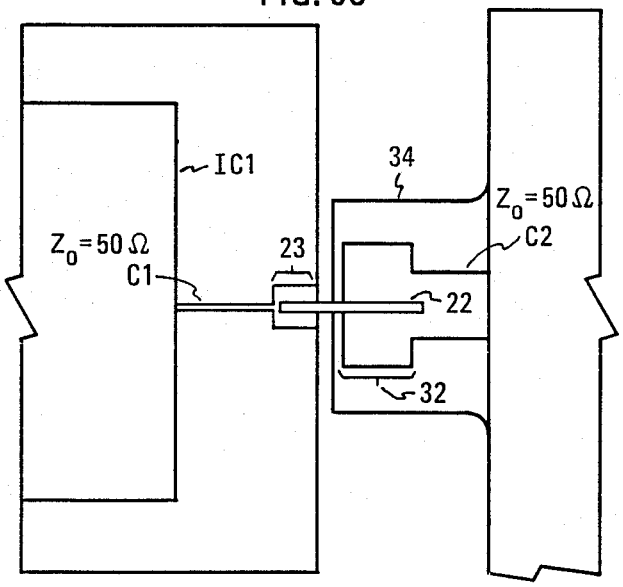

The details in the construction of a disconnectable transition between the module 12 and the beamformer distribution circuit 13 in accordance with a first embodiment are best seen in FIGS. 5A, 5B and 5C. As it enters the transition, the microstrip signal transmission line on the module 12 consists of an alumina dielectric layer (D1) 0.025" thick, having its undersurface bonded to a structural member G1 0.050" thick providing the ground plane. The member G1 is of layered Copper-Invar-Copper or Copper-Molybdenum-Copper having a low coefficient of thermal expansion chosen to match the alumina dielectric layer. The upper surface of the alumina is utilized for printed conductor runs and for bonding monolithic integrated circuits such as IC1. A conductor C1 of finite width is provided forming with the underlying dielectric layer D1 and ground plane G1, a microstrip transmission line, which has a characteristic impedance of 50 ohms (0.024" wide) as it enters the transition. (The conductor C1 ends with a widened portion or pad 23 (0.050" long×0.060" wide).)

Also referring to FIGS. 5A, 5B and 5C, the stripline on the beamformer distribution circuit 13 consists of an upper dielectric layer D2, typically of a resinous material composed of Teflon reinforced with glass micro fibers, such as "Duroid" and an underlying dielectric layer D3, arranged beneath the upper layer both 0.0625" thick. A second, upper ground plane G2 is provided, bonded to the upper surface of the upper dielectric layer D2 and a third ground plane G3 is provided, bonded to the undersurface of the dielectric layer D3.

At each transition, the lower portion of the stripline projects toward the microstrip line terminating in a short gap between the transmission lines. The upper dielectric layer D2 and the upper ground plane G2 do not extend into the transition, but a removable member 25 comprising in part extensions (D4, G4) of layer D2 and ground plane G2 respectively which continue through the transition to the gap. The under dielectric layer D3 and the under ground plane G3 project into the transition and terminate at the gap. The projection is 0.300" wide by 0.250" long. A conductor C2 of finite width is supported between the inner surfaces of the dielectric layers D2 and D3. The conductor C2 has a width of 0.100" selected so that the stripline has a characteristic impedance of 50 ohms as it enters the transition. (The second conductor C2 within the transition ends with a widened portion or pad 32 (0.100" long×0.170" wide).)

The strip and microstrip transmission lines, when their respective circuits 11, 13 and 12 are properly assembled on the chassis 21, are in mutual alignment and spaced at each transition by a small air gap. The length of the air gap is chosen large enough to allow convenient interconnection with the self supported flexible conductor, and small enough to decrease the uncertainities in the across-the-gap dimension. The gap is decreased to reduce the uncertainties in the electrical properties of the unsupported or "flying" portion of the conductor to the point where performance is not adversely affected. In a practical example, the gap, measured between the dielectric layers D1 and D3, is 0.025 inches.

The transition, in accordance with the first embodiment, is best seen in the views of FIGS. 5A, 5B and 5C. The electrically significant features of the transition include a ribbon shaped flying lead 22, the widened portion 23 of the conductor C1 of the microstrip, the widened portion 32 of the conductor C2 on a projecting lower portion 34 of the dielectric layer D3 of the stripline, and the removable member 25, comprising an extension (D4) of the upper dielectric layer D2, a ground plane G4 forming an extension of the upper ground plane G2 of the stripline and an elongate rectangular block 28. As will be further explained below, the rectangular block 28 has a transverse rectangular cutout forming a short waveguide section surrounding the transition, dimensioned to suppress the undesired waveguide mode in the transition with the side walls thickened enough to permit screw fastening and to suppress undesired radiation.

The removable member 25 is of a two part construction. The first part consists of a rectangular dielectric piece D4 with an attached ground plane G4, the part having approximately the same dimensions (0.250" long×0.306" wide) as the projecting lower portion 34 of the dielectric layer D3. The second part is an elongated rectangular conductive block 28, partially described above (0.250" long×0.90" wide (with a 0.050" lip)×0.175" thick). The transverse rectangular cutout which is 0.25" long×0.306"wide×0.125" high, fits the dielectric piece D4 and ground plane G4 and the lower dielectric projection 34 of D3 and ground plane G3. (Length is herein defined to be parallel to the stripline conductive, width being perpendicular to the stripline conductor and parallel to the ground plane, and height or thickness being perpendicular to the ground plane.) When the block 25 is fastened to the chassis by screws 31, as shown in FIG. 3, a short waveguide section is formed around the dielectric members (34, D4) on the stripline side of the transition continuing to the air gap. The width of the block 28 (except for lip. 35) equals the length of the dielectric piece D4 and of the projection 34. The length of the block 28 is made great enough to permit fastening by screws 31 without interference with the cutout. The extended sides of the block 28 are also useful in suppressing radiation by fringing fields at the junction between microstrip and stripline sections. Finally, the block 28 has a short extension 35 0.050" long×0.306" wide×0.050" thick, fitting over the adjacent ground plane G2 of the stripline to provide continuity with ground plane G4.

When the screws 31 are tightened, the assembly is held in place and the electrical integrity of the transition is assured. In particular, the conducting block 28 and extension 35 are of sufficient rigidity to insure contact of the conductive block with the ground plane G2, and to compress the contact 30 to insure contact between the ground planes G1 and G3 via the chassis 21. The tightening of the screws 31 also completes the contact between the inside walls of the cutout of the rectangular block with the ground planes G1 and G3, completing a conductive path about the dielectric member D4 and the projection of D3 to complete the short waveguide section mentioned above. Finally, as will be detailed below, the tightening of the screws biases the flying lead 22 into engagement with the conductor C2.

The dimensions of the block 28 are designed to perform the foregoing primarily mechanical functions. Electrically, the cutout of the block forms a waveguide section, which is designed to be in cutoff for the waveguide mode throughout the pass band to suppress the waveguide mode. The side walls adjacent the cutout extend 0.297"—approximately the length of the cross section of the waveguide to reduce fringing fields.

The ribbon shaped flying lead 22 which is bonded at the pad 23, to the conductor C1, extends across the gap between circuits and overlaps the second conductor C2 on the far side of the gap. The conductor C1 enters the transition with a width approximate to a 50 ohm characteristic impedance and is broadened at the pad 23, placed adjacent to the gap. The ribbon shaped flying lead has a width of 0.028 and a length of about 0.200 inches. At the bond to pad 23, the flying lead is narrower than the pad 23, so the effective width of the transmission path for defining the impedance is that of the pad. The effect of widening the microstrip conductor at the pad 23 is to reduce the impedance of the transmission line at this point, and to introduce a shunt capacitance to the signal transmission path. Since the length (0.050") of the pad, measured along the signal path is much less than one-fourth wavelength ($\lambda/4=0.625$"), the shunt capacitance may be treated as a lumped quantity.

The ribbon shaped flying lead 22, using similar considerations, exhibits a lumped series inductance as it crosses the gap between microstrip and stripline. Continuing from the point of disengagement from the bond to the pad 23 of conductor C1, the flying lead passes over the gap, becoming airborne, and continues to the point where contact is made with the stripline conductor C2. In making this passage, the distance of the lead to the ground plane increases, and the dielectric material becomes air. In consequence of these changes, the flying lead 22 exhibits a series inductance. The dimensions at the gap are small in terms of a quarter wavelength (0.025 versus 0.625) and the serial inductance may also be treated as a lumped serial inductance attributable to passage of the lead across the gap.

The extent of the overlap of the narrow width ribbon shaped flying lead over the much larger width conductor C2 of the stripline provides reasonable flexure of the flying lead and assures positive engagement between the flying lead and the conductor C2. The overlap of the narrow flying lead with the wide conductor C2 does not significantly affect the local reactances of the transition, which are essentially determined by the larger dimensions of the conductor C2, against which the flying lead rests.

The pad 32 on the conductor (C2) on the stripline side of the transition is provided to furnish shunt capacitance at the transition. The widened portion or pad (32) is 0.170" wide and 0.100" long. This width is greater than 0.100" (the width of C2), which corresponds to a characteristic impedance of 50 ohms. The widening at the pad 32 produces a substantial reduction in impedance. The axial extent of the widening is a small fraction of a quarter wavelength (0.100" vs 0.625") and its electrical effect may be represented as an equivalent lumped capacitance connected in shunt with the signal path.

Adjustment of the dimensions of the widened portion of conductor C1 at 23, control of the unsupported length and width of the flying lead, and adjustment of the dimensions of the widened portion 32 of conductor C2, provide means to obtain the desired electrical response for the transition. As implied above, the transition may be regarded as a pi network consisting of a pair of shunt capacitances and a series inductance. This pi network is a low pass network. It may be designed to pass signals having a substantial bandwidth if the shunt capacitances and series inductance values are properly selected to place the upper limit of the pass band above the desired operating frequencies. Selection of the correct physical dimensions allows one to select the desired shunt capacitances and series inductance and thus achieve the desired electrical response in the transition.

The electrical performance of the transition is enhanced by the conductive block 28 with its cutout. As earlier suggested, the cutout in cooperation with the chassis and other elements of the transition, completes a short waveguide section enclosing the conductor C2 and a portion of the flying lead 22.

The electrical performance of the transition may be described in either direction of transmission. However, let us assume that the microstrip circuit is feeding the stripline circuit through the transition, with the E-field in the microstrip assumed to be (momentarily) downward. The E-field in the microstrip has a substantial tendency to excite a desired TEM mode in the stripline with E-fields extending (momentarily) downward across the lower half of the stripline and upward across the upper half of the stripline. At the same time, there is a substantial tendency to excite a parallel plate or TE 10 mode in the stripline with the E-field (momentarily) downward in both the upper and lower halves of the stripline. The parallel plate mode can readily absorb a large portion of the energy from the microstrip and destroy the effectiveness of the transition.

The waveguide section formed between the inner walls of the member 25 and the chassis 21, and containing the dielectric of D3 and D4, is accordingly dimensioned to have a cutoff frequency below the frequencies of the signals being coupled to the transition. The presence of the waveguide section which is below cutoff for the signal frequencies propagating in the TE 10 mode, suppresses that mode, and causes substantially all of the available energy fed from the microstrip to be used to excite the desired TEM stripline mode.

As also indicated earlier, the very wide side walls (0.297") to the waveguide section function to reduce radiation of any fringing fields at the junction between the microstrip and the stripline. The wide sidewalls of the block, which are approximately equal to the width dimension of the waveguide, serve to minimize launching of any fields on the outside of the side walls of the waveguide and hence improve the efficiency of the transition between the microstrip and the stripline. In addition, the lip 35 on the block 28 connects the upper ground plane G2 to the ground plane G4 on the dielectric D4 and thus prevents radio frequency leakage at the junction between these ground planes.

The dimensions which have been provided are optimized for operation in the 5 to 6 Gigahertz region. They will require modification when the transition is intended to be used at other operating frequencies.

Figure 4:
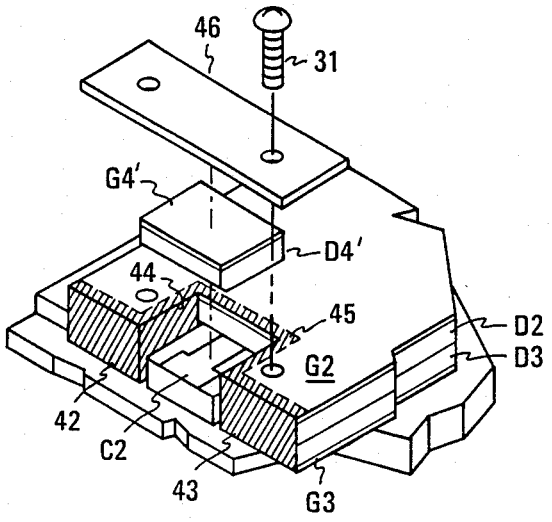
FIG. 4 is an exploded perspective view of a portion of a disconnectable microstrip to stripline transition in accordance with a second- embodiment of the invention.

An alternate embodiment of the invention is provided in the exploded-perspective view of FIG. 4. Here only the stripline circuit and the demountable transitioning means associated with the stripline are shown. The dielectric layers D2 and D3 and the upper and lower ground planes G2 and G3 of the stripline are cut by two narrow slots, one to the left and one to the right of the conductor C2. The slots are to a depth of 0.25 inches, and the outer edges of the slots are spaced 0.306" apart. The upper portion of the dielectric D2 including the upper ground plane G2 is removed in the rectangular area bounded by the two slots.

As shown in FIG. 4, the upper and lower ground planes G2 and G3 of the stripline are then connected together in the region of the transition by a thin conductive layer which also act as the walls of a short waveguide section at the transition. The conductive layer 42 may be provided by electro plating or by a copper foil folded over the upper and lower ground planes and soldered.

Assuming a foil construction, the foil is applied to the exposed front wall of the stripline for a substantial distance to either side of the slots as shown at 42 and 43 and to a narrow region on the upper and the lower ground planes G2, G3 where soldering takes place. The foil is applied to the left slot along the left wall as shown at 44 including narrow regions on the ground planes G2 and G3. At the inner end of the slot, the exposed edge of the dielectric D2 is left uncoated but the upper ground plane G2 between the slots is coated as shown at 45 to facilitate continuous contact with a cover plate. The right wall of the right slot is coated, (including narrow regions on the ground planes G2 and G3) and connects to the foil portion 43 applied to the front wall of the stripline. The foil coating (42–45) provides both a shorting connection between ground planes G2 and G3 in the stripline and the side walls to a short waveguide section.

The removable members of the transition include a dielectric filler D4' and an elongated cover plate 46. The dielectric filler D4' is dimensioned to fit into the rectangular region where the upper dielectric D2 is absent. A removable elongated cover plate 46 is provided having a width substantially greater than the width of the transition region. The length of the cover plate 46 exceeds the length of the transition so as to overlap the foil surfaces on the upper ground plane. The cover plate is provided with mounting holes for fastening screws 31.

The foil embodiment of FIG. 4 represents a variation of the first embodiment, but utilizes common principles. When the cover plate 46 is fastened by the screws 31, it engages the foil lip on the upper conductive layer G2 and connects with the foil coating the side walls of the transition. At the same time the foil overlapping the lower conductive layer G3 is pressed into engagement with the chassis 21. Thus a continuous conductive waveguide section, filled with dielectric and encircling the transition is formed consisting of the cover plate 46, the foil coating the sides of the slots, and the upper surface of the chassis 21. This waveguide section is dimensioned, as in the case of the first embodiment, to be below cut-off for propagation of the undesired TE 10 mode over the operating frequencies in order to suppress that mode and facilitate propagation of only the desired TEM stripline mode.

Finally, the front face of the stripline also contains a foil interconnecting the ground planes and to suppress radiation by fringing fields at the junction between microstrip and stripline sections.

Figure 6:
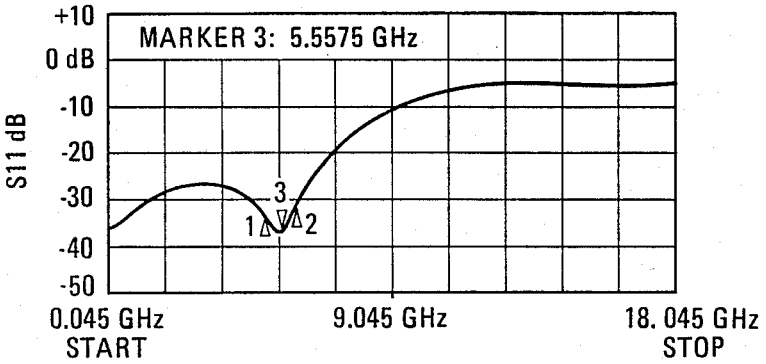
FIG. 6 is a chart illustrating the return loss of the transition over a specified band of operating frequencies.

Examples of a disconnectable transition in accordance with the first embodiment have been measured over a range of from 0.045 GHZ to 18.045 GHz. The performance of one example over that range in respect to reflection (S11) is graphed in FIG. 6. The dimensions are tuned for a band center of 5.5 Gigahertz, and remain below −30 db at the band markers corresponding to 5 and 6 Gigahertz where the transition is designed to operate. The forward attenuation is small, estimated to be about 0.1 db. The arrangement may be tuned, both to locate the notch and to broaden the region of optimum performance. Good electrical performance requires care in dimensioning the flying lead 22, the gap, and the dimensions of the conductors C1 and C2 particularly at the pads 23 and 32.

The preferred substrate material for the microstrip circuit is a three layer composite of Copper, Invar, and Copper with an alumina dielectric. The dielectric material employed for the stripline may be one of several available microwave laminates, as for instance "Duroid". Appropriate laminates are characterized by a low dielectric constant (e.g. 2.2), good tensile, and compressive properties, and a low coefficient of thermal expansion in a plane parallel to the lamina.

What is claimed is:

1. In combination:

(A) a mechanically rigid chassis, (B) a first electronic circuit attached to said chassis employing a microstrip transmission line of a given characteristic impedance (Z), comprising a first dielectric layer having a first ground plane, and a first portion of a first conductor having a first width, (c) a second electronic circuit attached to said chassis employing a stripline transmission line of said given characteristic impedance (Z), comprising a second dielectric layer having a second ground plane, a third dielectric layer having a third ground plane, said third dielectric layer being disposed in parallel proximity to said second dielectric layer, and having a rectangular extension with ground plane projecting beyond said second dielectric layer; a second conductor of finite width supported between said second dielectric layer and said third dielectric layer and supported upon said rectangular extension, a first portion of said second conductor having a first width selected to achieve said characteristic impedance (Z);

said electronic circuits, when attached to said chassis, being positioned to provide a short air gap between the dielectric layer and ground plane of said microstrip transmission line and the rectangular extension of the third dielectric layer and third ground plane of said stripline transmission line for convenient interconnection, and (d) demountable transitioning means comprising (1) a second portion of said first conductor adjacent said pair gap having a second width greater than said first width, to create a first equivalent low impedance shunt capacitance localized along said second portion, (2) a flexible flying lead bonded to the second portion of said first conductor, extending across said gap and overlapping said second conductor, said flying lead having a width across said air gap selected to exhibit an equivalent high impedance, series inductance localized along said air gap, (3) a second portion of said second conductor adjacent said air gap, having a second width, greater than said first width, to create a second equivalent low impedance shunt capacitance localized along said second portion, the combination of said first and second equivalent shut capacitances and said series inductance providing a desired pass band, and (4) means to facilitate demounting said transition and to suppress the undesired waveguide mode in the transition comprising (a) a fourth removable rectangular dielectric layer which forms an electrically continuous extension of the second dielectric layer coextensive with the rectangular extension of said third dielectric layer and (b) conductive means comprising (i) a first removable conductive member which forms an electrically continuous extension of said second ground plane to said air gap, and (ii) a pair of vertical conductive members interconnecting said first removable conductive member and said third ground plane to form a short rectangular waveguide section containing said fourth dielectric layer and the rectangular extension of said third dielectric layer and ending at said gap, said vertical conductive members defining side walls of a waveguide section, the dimensions of which suppress the waveguide mode by being below cut-off through said desired passband, said fourth removable dielectric layer, when in position, pressing said flexible flying lead into electrical contact with said second conductor to connect said first and second electronic circuits together.

2. The combination set forth in claim 1 wherein said conductive means further includes (iii) a second pair of vertical conductive members extending from both side walls of said waveguide section and between the planes of said second and third ground planes to suppress radiation by fringing fields at the junction between said microstrip and stripline sections.

3. The combination set forth in claim 2 wherein said conductive means are unitary in the form of an elongated rectangular block substantially longer than the width of said waveguide section, having a thickness greater than said stripline and having a transverses rectangular cutout forming the top and sides of said waveguide section.

4. The combination set forth in claim 3 having in addition thereto a fourth ground plane bonded to said fourth dielectric layer, and in contact with said first removable conductive member, and wherein said elongated rectangular block has a lip on the upper surface for contact between said second and fourth ground planes.

5. The combination set forth in claim 4 having in addition thereto (c) a pair of adjustable fastening means engaging said chassis and each portion of said block beside said cutout, adjustment compressing said flexible flying lead into engagement with said second conductor.

6. The combination set forth in claim 5 having in addition thereto (d) a resilient electrical contact strip supported along said gap and between said chassis and said first and second circuits, said adjustment compressing said contact strip against said first and third ground planes to provide electrical connection between said first and third ground planes.

7. The arrangement set forth in claim 2 wherein said first conductive member consists of a rigid rectangular plate and said first pair of vertical conductive members are formed by a thin conductive layer attached to the adjoining surfaces of said stripline, to form respectively the top and sides of said waveguide section and the second pair of vertical conductive members for suppressing said fringing fields.

8. The combination set forth in claim 7 having in addition thereto (c) a pair of adjustable fastening means engaging said chassis and said rigid rectangular plate, adjustment compressing said flexible flying lead into engagement with said second conductor.

9. The combination set forth in claim 8 having in addition thereto (d) a resilient electrical contact strip supported along said gap and between said chassis and said first and second circuits, said adjustment compressing said contact strip against said first and third ground planes to provide electrical connection between said first and third ground planes.

* * * * *